US005765963A

United States Patent [19]

Roberts

[11] Patent Number: 5,765,963

[45] Date of Patent: Jun. 16, 1998

[54] PAVEMENT MAINTENANCE VEHICLE

[76] Inventor: Keith A Roberts, 13263 Morgan Rd., Gillett, Wis. 54124

[21] Appl. No.: 723,763

[22] Filed: Sep. 30, 1996

[51] Int. Cl.[6] ..... E01C 19/18; E01C 23/08; E01C 23/12

[52] U.S. Cl. ..... 404/92; 404/101; 404/108; 404/111; 404/107

[58] Field of Search ..... 404/101, 107, 404/108, 111, 92

[56] References Cited

U.S. PATENT DOCUMENTS

| | | | |
|---|---|---|---|
| 336,164 | 2/1886 | Schillinger | 404/92 |
| 3,771,893 | 11/1973 | Miller | 404/101 |
| 4,219,093 | 8/1980 | Lang | 180/131 |
| 4,688,964 | 8/1987 | Cox | 404/75 |
| 4,887,741 | 12/1989 | Downing | 222/146.5 |
| 4,964,752 | 10/1990 | Astrope et al. | 404/92 |
| 5,002,426 | 3/1991 | Brown et al. | 404/92 |
| 5,006,012 | 4/1991 | Sterner | 404/107 |
| 5,215,403 | 6/1993 | Peterson | 404/101 |
| 5,232,306 | 8/1993 | Sterner | 404/107 |
| 5,401,115 | 3/1995 | Musil et al. | 404/72 |
| 5,529,434 | 6/1996 | Swisher, Jr. | 404/108 |
| 5,553,969 | 9/1996 | Reed | 404/110 |

OTHER PUBLICATIONS

The 1996 "SealMaster" catalog, p. 23.

*Primary Examiner*—Tamara L. Graysay
*Assistant Examiner*—Gary S. Hartmann
*Attorney, Agent, or Firm*—Joseph M. Recka; Recka & Joannes SC

[57] ABSTRACT

An improved ride-on, self propelled, pavement maintenance vehicle suitable for applying liquid sealing material, such as asphalt or coal tar emulsions and other pavement coatings, upon large, relatively flat, surfaces such as automobile parking lots, roadways, etc. is disclosed.

2 Claims, 9 Drawing Sheets

FIG.6A
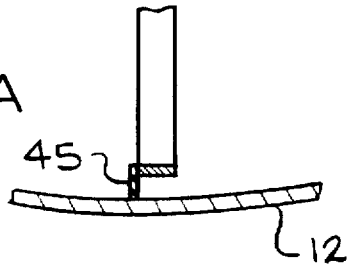
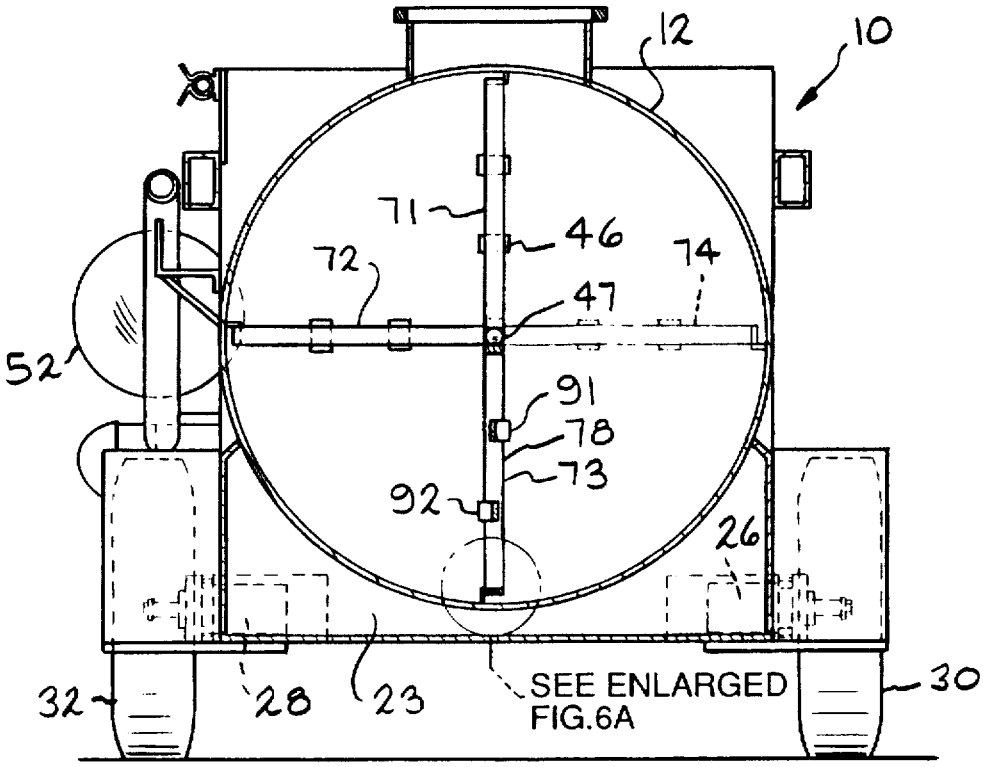
FIG. 6

PAVEMENT MAINTENANCE VEHICLE

BACKGROUND OF THE INVENTION

The present invention relates to improvements in a ride-on, self propelled, pavement maintenance vehicle suitable for applying liquid sealing material, such as asphalt or coal tar emulsions and other pavement coatings, upon large, relatively flat, surfaces such as automobile parking lots, roadways, etc.

PRIOR ART

Prior art vehicles of this type exhibit a basic structure comprising a cylindrical storage tank, of approximately two to three hundred gallons capacity, and having its center line positioned parallel to the surface. Powered rear support wheels are typically affixed to the rear portion of the storage tank with the front portion of the vehicle comprising a forwardly extending support structure, also affixed to the forward portion of the storage tank, and having a single, steerable front wheel affixed thereto forming a tricycle type vehicular structure.

Also typically supported upon the forwardly extending structure is an internal combustion engine, gasoline or diesel, for providing the necessary motive power to drive the rear support wheels and provide power for other accessories such as a pump for pumping the material being applied upon the roadway surface.

Typically extending rearward from and affixed to the rear bulkhead of the storage tank is a fabricated, cantilever beam structure supporting thereon an operators seat. The seat is positioned such that when seated thereupon, the operator' legs straddle the cantilever beam structure. Also typically affixed to and extending rearwardly from the lower rear portion of the tank bulk head is a, manually lifted, squeegee assembly for spreading sealing material across the surface being treated. A simple, valve operated, discharge conduit is typically provided at the bottom rear of the storage tank for delivery of sealing material to the trailing squeegee assembly. Alternately a spray bar, having a multiplicity of spray nozzles thereon, is typically attached to the seat structure for spraying material upon the surface being treated. When equipped with a spray bar, a hydraulically driven piston or dual diaphragm pump is typically used to provide pressurized material to the spray nozzles.

Self propelled, ride-on pavement maintenance vehicles, of the prior art have many disadvantages; the principle disadvantages being:

1) The three wheel tricycle support provides a relatively unstable vehicle, particularly when turning, and because of the vehicles heavy gross weight (approximately 5,000 to 6,000 pounds) an extreme load is placed upon the single steerable front wheel, many times causing damage to the wheel support structure and/or the tire.
2) The hydraulic driven piston pumps, commonly used to supply pressurized material to the spray bar, are incapable of handling coarse abrasives contained in many materials and subject to cylinder scoring, by sand contained within the materials. Piston pumps cannot adequately handle coarse materials such as the "Black Beauty Aggregate" an extremely hard, but very popular, material commonly used in the pavement maintenance industry, without damage to the pumps cylinder walls and seals.
3) Hydraulic driven diaphragm pumps require high volume, low pressure oil and in the event of a diaphragm rupture, the hydraulic system will be contaminated with the abrasives contained within the sealers and/or resurfacers being pumped. Also cross contamination of the waterborne material within the storage tank will also occur.
4) The vehicle operator must operate the vehicle in a sitting position and with his legs astride the seat supporting structure thereby restricting body movement while operating the machine.

SUMMARY OF MY INVENTION

My improved pavement maintenance vehicle overcomes the disadvantages of the prior art machines by providing a four wheeled steerable vehicle which can maneuver as well as the prior art tricycle type vehicles and thereby provides two front wheels to share the load when operating. Further, my improved vehicle includes an operators platform and seat providing more operator comfort and accommodating operation of the vehicle in a standing position.

Also included in my improved pavement maintenance vehicle is an air operated dual diaphragm pump for providing pressurized material to the spray bar and/or a hand operated spray wand.

BRIEF DESCRIPTION OF THE DRAWINGS

FIG. 6 is a cross sectional view taken along line 6—6 in FIG. 1.

FIG. 6A is an enlarged view of the area circled in FIG. 6.

DETAILED DESCRIPTION OF THE INVENTION

FIGS. 1, 2, 3, 4, and 5 illustrate side, front, and rear views of a pavement maintenance vehicle 10 embodying my invention. For ready understanding of the vehicle's fluid flow systems FIG. 9 is provided presenting a schematic diagram of the principle elements and their functional relationship with one another.

Figure 9:
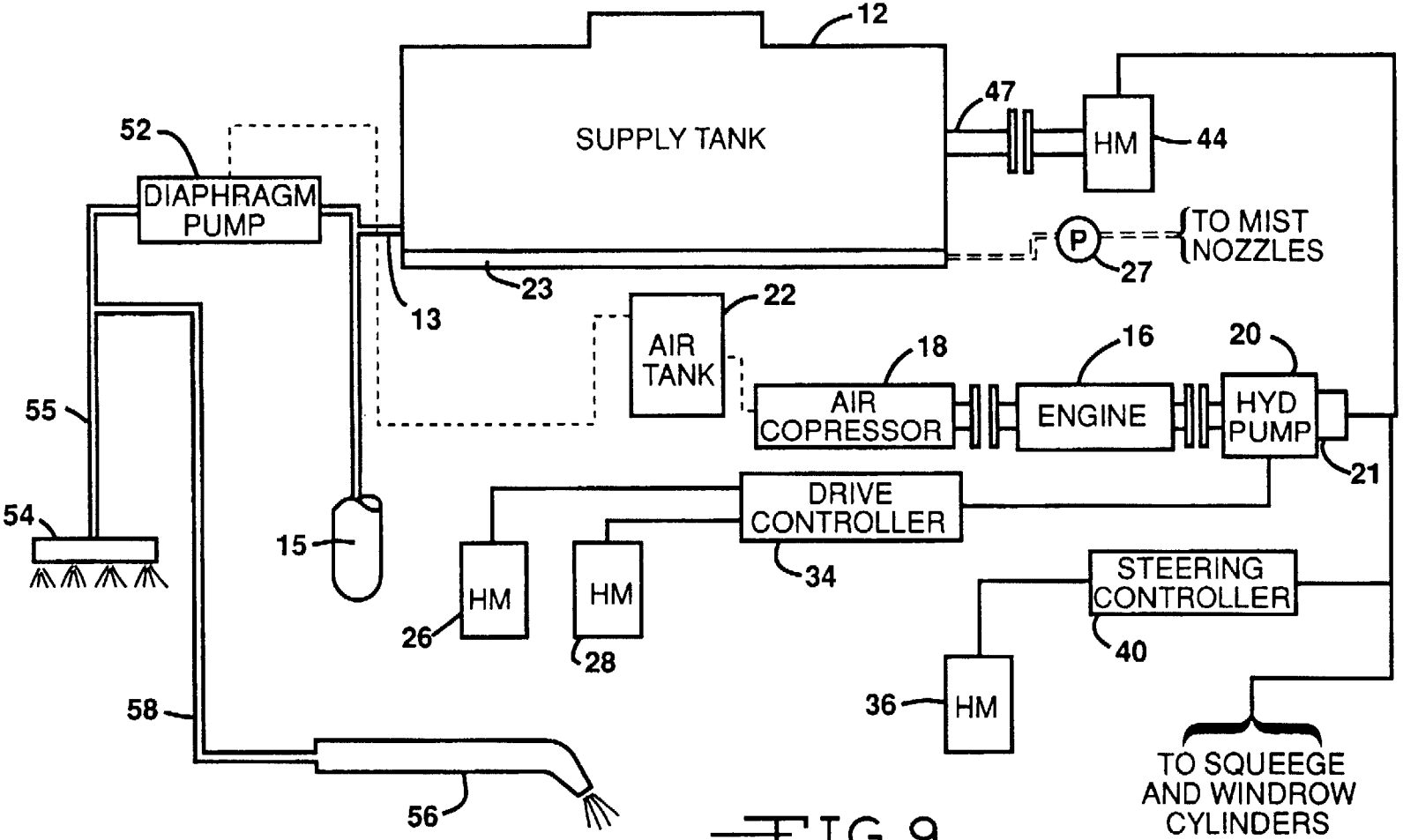
FIG. 9 presents a fluid flow chart schematically showing the principle elements of my improved pavement maintenance vehicle and their functional relationship with one another.

In FIG. 9 the double solid lines represent those conduits carrying liquid pavement application material; the double broken line represents conduits carrying water; the single broken lines represent conduits carrying pressurized air; and the thin solid lines represent conduits carrying pressurized hydraulic fluid. For simplicity, all control valves etc. have not been shown as such valves are largely a matter of personal preference and one skilled in the art of hydraulic fluid systems can readily design an adequate system to suit a particular vehicle in accord with the invention as described herein.

Referring now to FIGS. 1 through 6 and FIG. 9 the present invention will be described in more detail.

My improved pavement maintenance vehicle 10 comprises a main storage tank 12 having a forwardly extended accessory support frame 14 affixed to and extending forward from the forward portion of tank 12. Below tank 12 and circumscribing a portion thereof, as illustrated in FIG. 6, is an integrated water tank 23 which may extend the length of tank 12. Water in tank 23 is typically conveyed, by an electric motor driven pump 27, to misting nozzles (not shown) at the front of the vehicle. Such misting nozzles are communally used to dampen the surface being treated prior to material application. The water carried within tank 23 may also be used for cleaning purposes when conveyed through a typical garden hose (not shown).

Conveniently positioned upon support frame 14 is an internal combustion engine 16, either gasoline or diesel, an air compressor 18, a hydraulic pump 20, and compressed air storage tank 22. Engine 16 is the primary source of power for the vehicle systems.

Hydraulic pump 20 is driven by a direct drive coupling 24 to engine 16 thereby providing a source of pressurized hydraulic fluid for driving hydraulic motors 26 and 28 which drive rear support wheels 30 and 32 by way of a hydrostatic drive and braking controller 34. Coupled to hydraulic pump 20 is secondary hydraulic pump 21 which provides a separate source of pressurized hydraulic fluid for powering hydraulic motor 36 which provides power steering of the front steerable wheel assembly 110 through power steering controller 40, hydraulic motor 44 which powers the main tank mixing apparatus 46, and the squeegee lift cylinder 48. Thus two separate hydraulic systems are provided, one for powering the rear drive wheels and a second system to power the other hydraulic accessories. Power steering controller 40 preferably includes an adjustable steering wheel that may be adjusted to suit the operator.

Air compressor 18 is driven by engine 16 by way of a V-belt drive 19. Compressed air is stored within air tank 22 from which it is supplied to air driven dual diaphragm pump 52. A suitable air operated dual diaphragm pump, for this application, is pump model no. M-8 manufactured by the Wilden Pump Company of Colton, Calif. Air operated diaphragm pump 52 draws pavement sealing material from discharge conduit 13 of supply tank 12 and supplies said material, under pressure, to spray bar 54 via flexible conduit 55. Alternatively, with appropriate valving, pavement sealing material may be delivered, under pressure, from air diaphragm pump 52 to a hand operated spray wand 56 through flexible conduit 58.

An air operated dual diaphragm pump is preferred, over the pumps used in prior art machines, because it can adequately pump very abrasive materials, such as the popular "Black Beauty Aggregate," without internal damage to the pump. The air operated dual diaphragm pump can also run dry without damage and can be easily flushed-out and cleaned without damage. In the event of a diaphragm rupture pavement sealing material will not contaminate the hydraulic system of the machine as in the case of the hydraulically operated diaphragm pumps of prior art machines and cross contamination of the sealing material being applied is eliminated.

Figure 7:
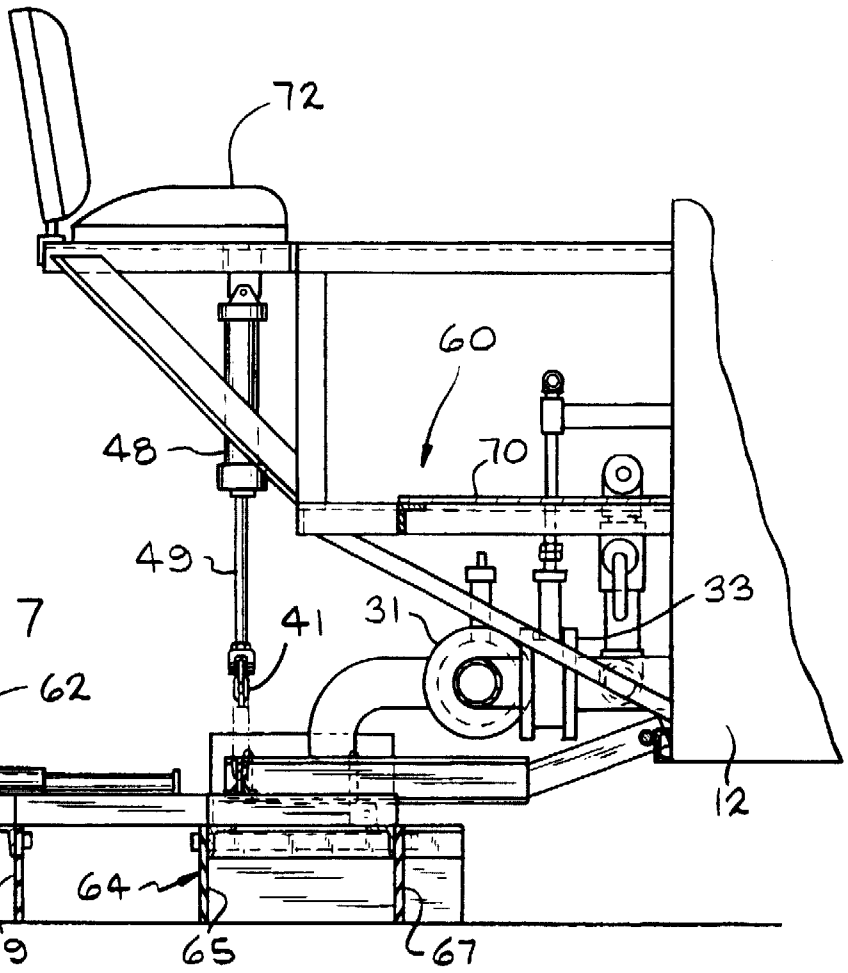
FIG. 7 is a cross sectional view taken along line 7—7 in FIG. 5.

Securely affixed to the rear of supply tank 12, as best illustrated in FIG. 7, is an operator's platform 60 comprising a suitable frame structure 68 having a floor 70 and seat 72. Seat 72 may be adjustable, up or down, forward or backward, by appropriate mechanical linkage (not shown) for the comfort of the operator. Further it is desirable to provide steps or a ladder (not shown) for ease of the operator's mounting or dismounting the vehicle.

Beneath the operator's platform 60 and hingedly affixed to the rear of supply tank 12 is a squeegee/windrow/spray bar assembly 62 comprising a squeegee box 64, a windrow 66, and spray bar 54. Suspended from the operator's platform is hydraulic cylinder 48 having its operating piston stem 49 attached to squeegee assembly 62 by chain 41. By use of appropriate valving and controls, not shown, the operator may hydraulically raise or lower the squeegee assembly depending upon whether the squeegee/windrow combination or the spray bar is being used to apply sealing material to the pavement.

Since the structural design of the squeegee assembly 64 and windrow assembly 66 is within the knowledge of persons skilled in this technology, the details of the specific structure used in the present invention will not be elaborated upon in the interest of brevity.

Liquid sealing material is delivered to squeegee assembly 64, by gravity flow, from storage tank 12, through discharge manifold 13, control valves 29 and 31 and into the squeegee box via elbows 15. Butterfly control valves 29 and 31 are controlled by hydraulic cylinders 42 and 43 respectfully. Thus, with appropriate hydraulic valving (not shown) the operator may selectively and easily open and close valves 29 and 31 separately and/or collectively thereby eliminating manual actuation of supply valves as used in prior art machines.

I have found that the flexible portions 65, 67, 68, and 69 of the squeegee assembly 62 and the windrow assembly 66 respectively, perform best if made of neoprene rubber having a durometer of 60.

Windrow assembly 66 may be selectively positioned, by the operator, at any desired angle to the vehicle centerline by hydraulic piston 50. The detailed valving and fluid circuitry is not shown as it is within the knowledge of any person skilled within this particular technology.

Figure 5:
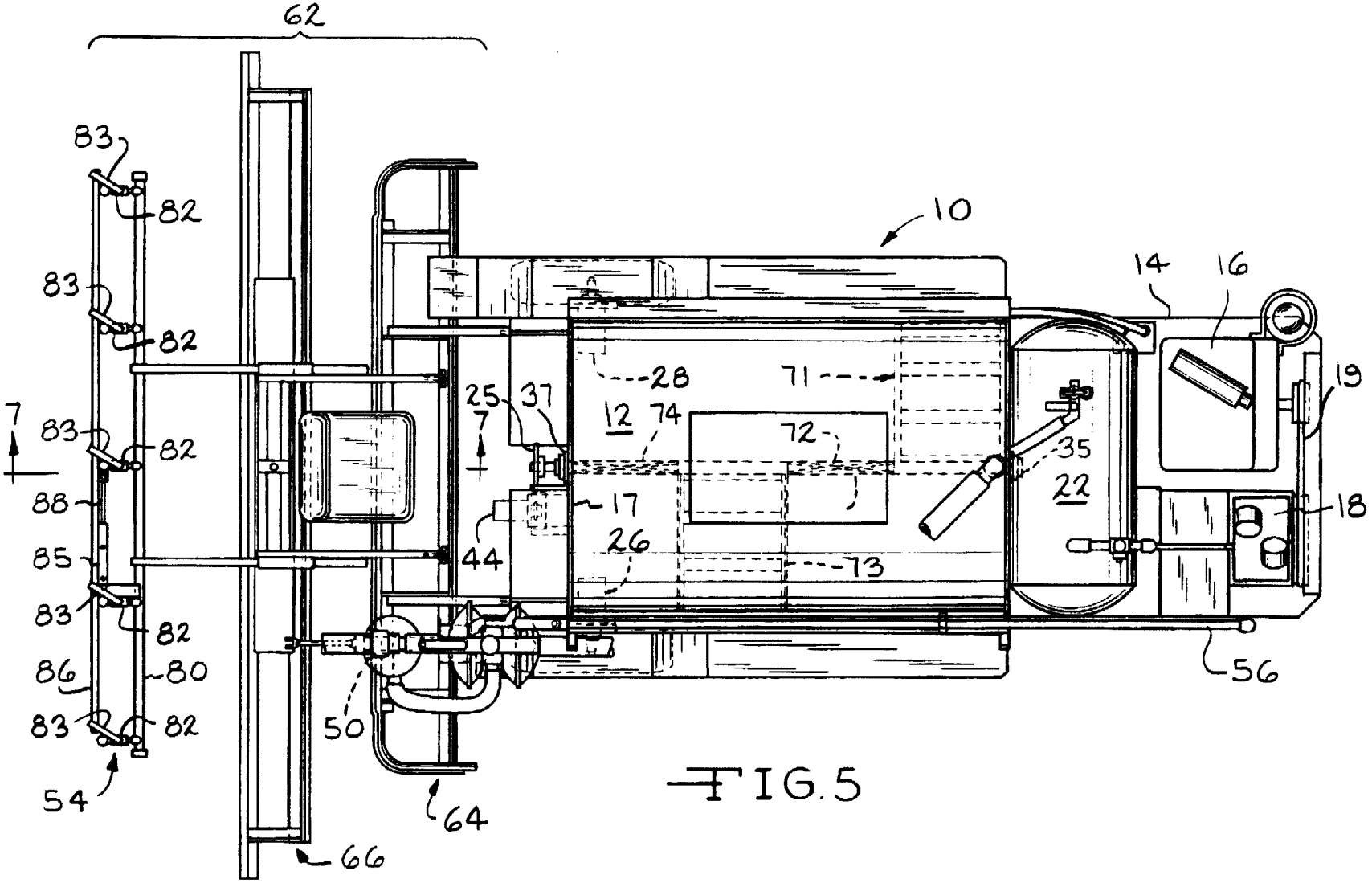
FIG. 5 presents a top plan view of my improved pavement maintenance vehicle.

As best seen in FIGS. 5 and 7, spray bar assembly 54 attached to squeegee assembly 62 generally comprises a supply manifold 80 having a multiple number of spray nozzles 81 extending therefrom as best seen in FIG. 7. Each spray nozzle 81 includes an upstream lever operated ball valve 82 for activating and deactivating the nozzle. A control rod 86 is pivotally attached to the operating lever 83 of each ball valve 82. Hydraulic control cylinder 85 fixedly attached to manifold 80 has its hydraulically operated piston rod 88 pivotally attached to valve control rod 86. Thus through appropriate hydraulic circuitry the operator may selectively open or close all spray nozzles simultaneously.

Figure 8:
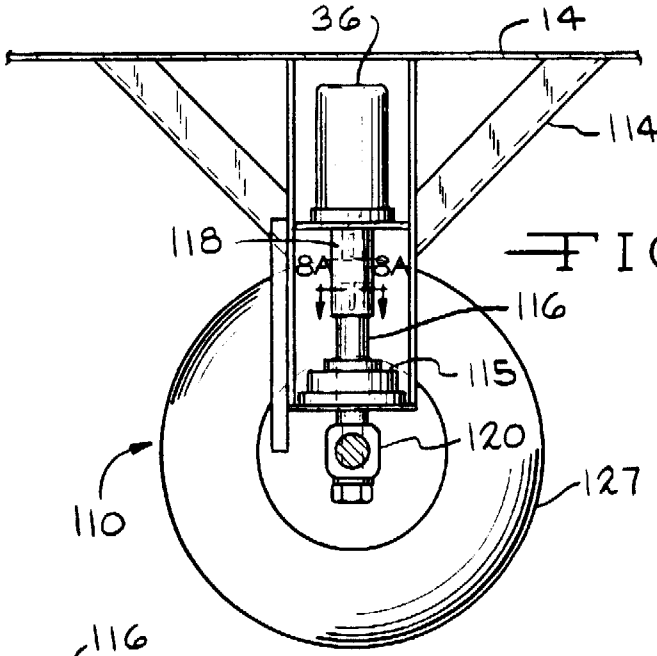
FIG. 8 is a cross sectional view taken along line 8—8 in FIG. 3.
Figure 8A:
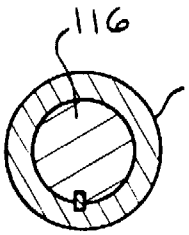
FIG. 8A is a cross sectional view as taken along line 8A—8A in FIG. 8.

Referring now to FIGS. 1, 2, 3, and 8, suspended from forward support frame 14 is a triangular structure 114 for accommodating the steerable dual wheel assembly 110. Dual wheel assembly 110 generally comprises an axle bar 120 having typical automotive axle/wheel spindles 123 and 122 for attachment of automotive type wheel assemblies 126 and 127 thereto. Alternatively, axle bar 120 could be fitted with automotive type wheel and bearing assemblies as typically used on the rear axles of front wheel drive automobiles. Extending upward from axle bar 120, through bearing assembly 115 is steering shaft 116 coupled to the rotatable output shaft of hydraulic steering motor 36 by sleeve 118. The output shaft of motor 36 and steering shaft 116 maybe keyed to sleeve 118 as shown in FIG. 8A or maybe coupled by any other suitable means such as a splined coupling. Thus the axle bar 120, with wheels 126 and 127 attached thereto, may be rotated through eighty three degrees in either direction thereby providing the same degree of steerability as the single steerable wheel found on prior art machines having a tricycle wheel support.

Figure 1:
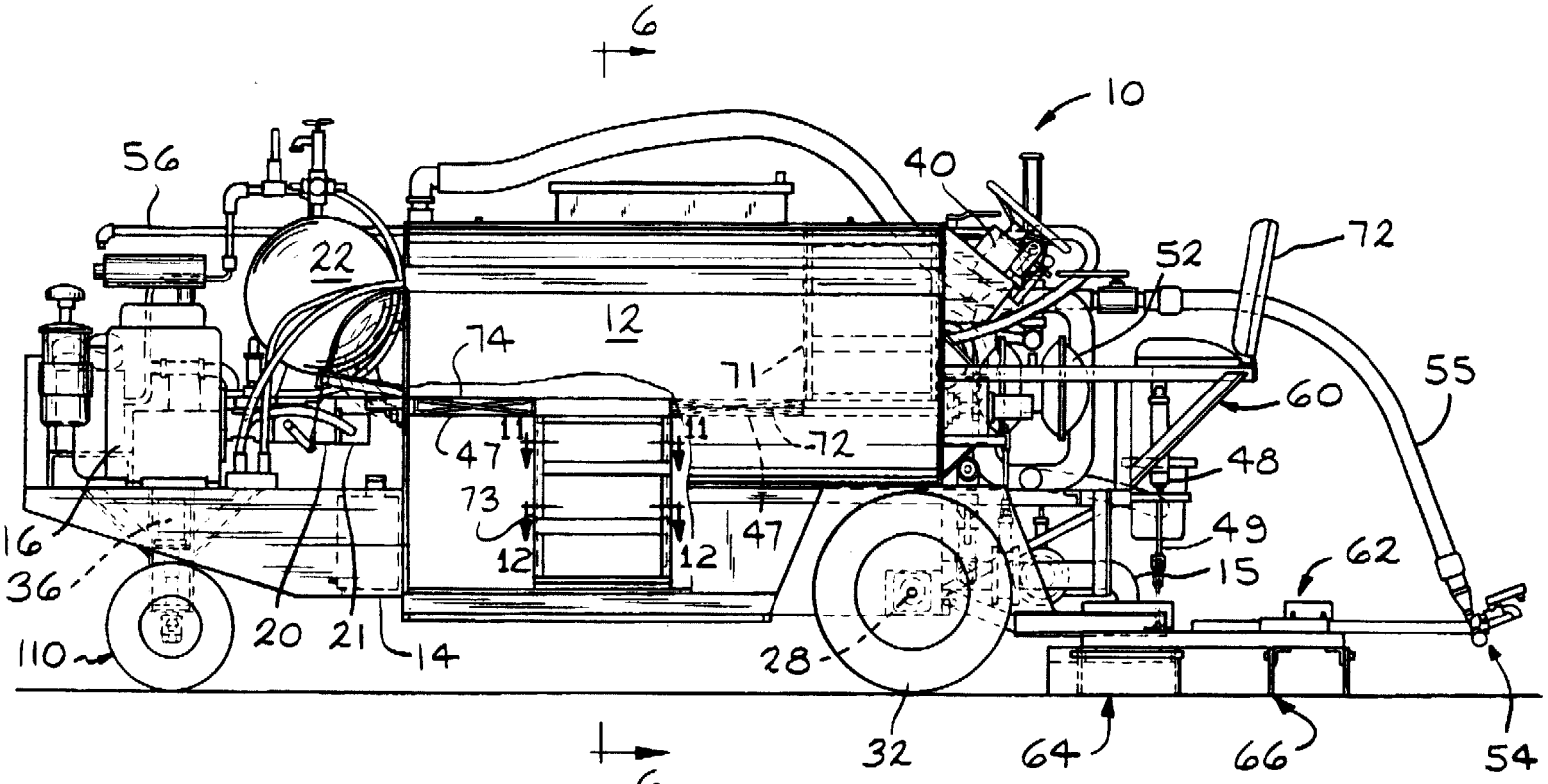
FIG. 1 presents a left side elevational view of my improved pavement maintenance vehicle.
Figure 2:
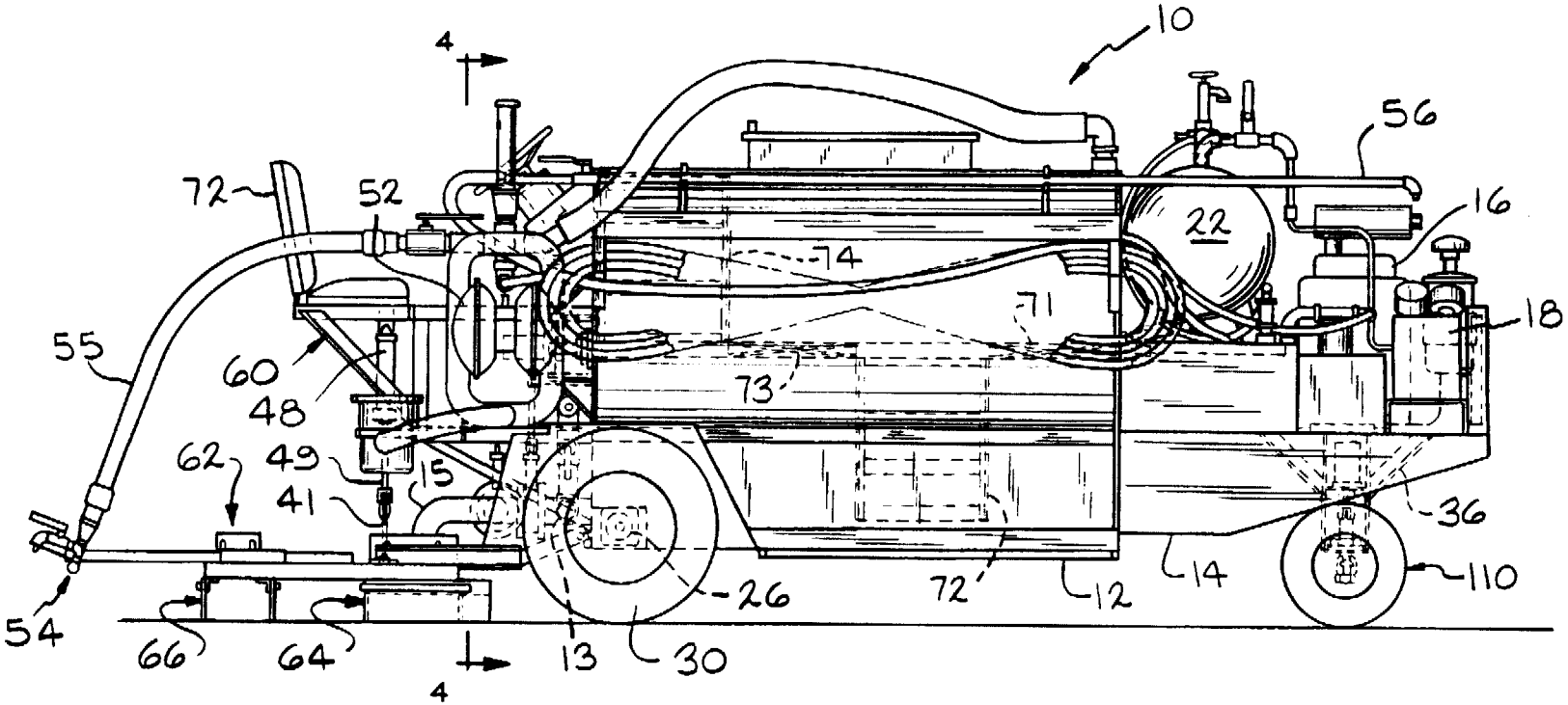
FIG. 2 presents a right side elevational view of my improved pavement maintenance vehicle.
Figure 3:
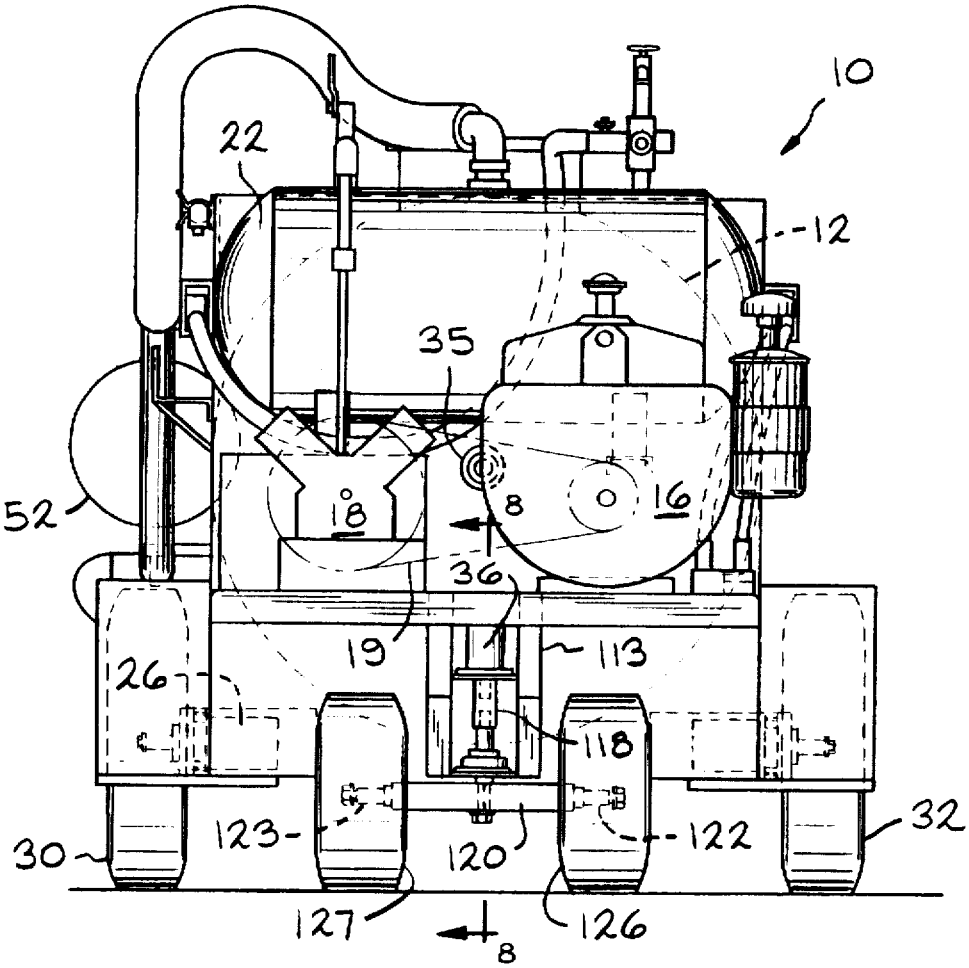
FIG. 3 presents a front elevational view of my improved pavement maintenance vehicle.
Figure 4:
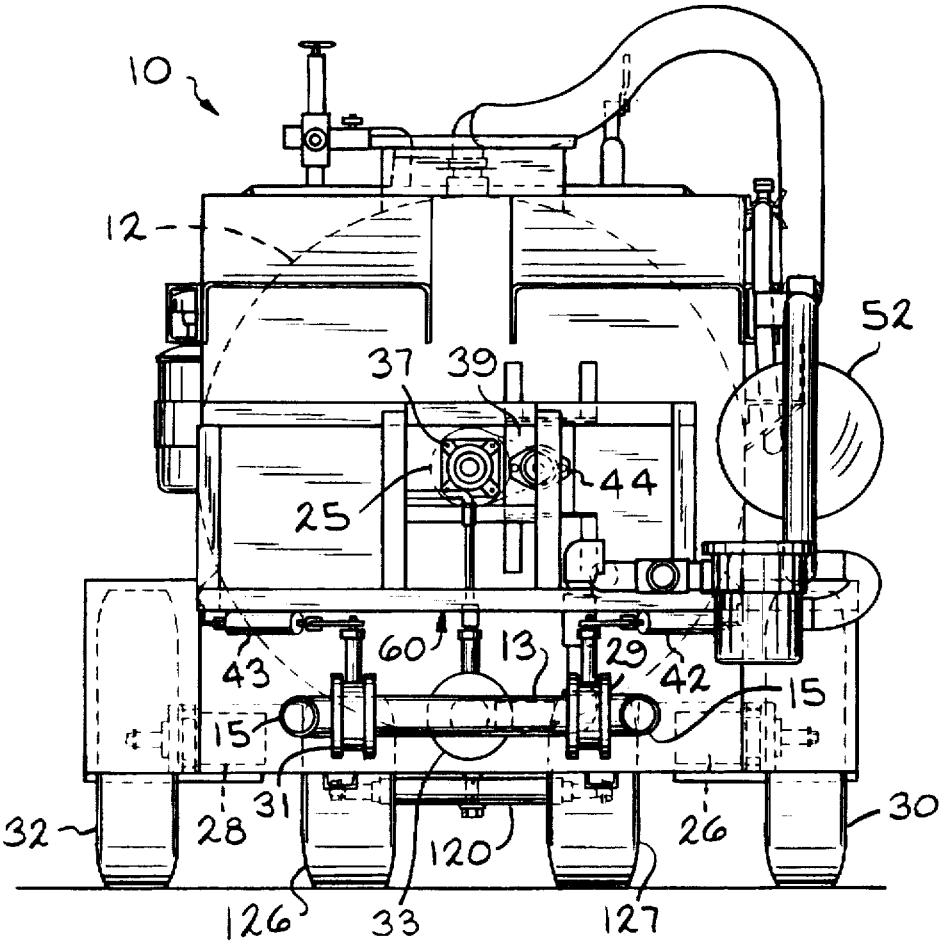
FIG. 4 presents a rear elevational view of my improved pavement maintenance vehicle as taken along line 4—4 in FIG. 2.
Figures 10, 11, 12:
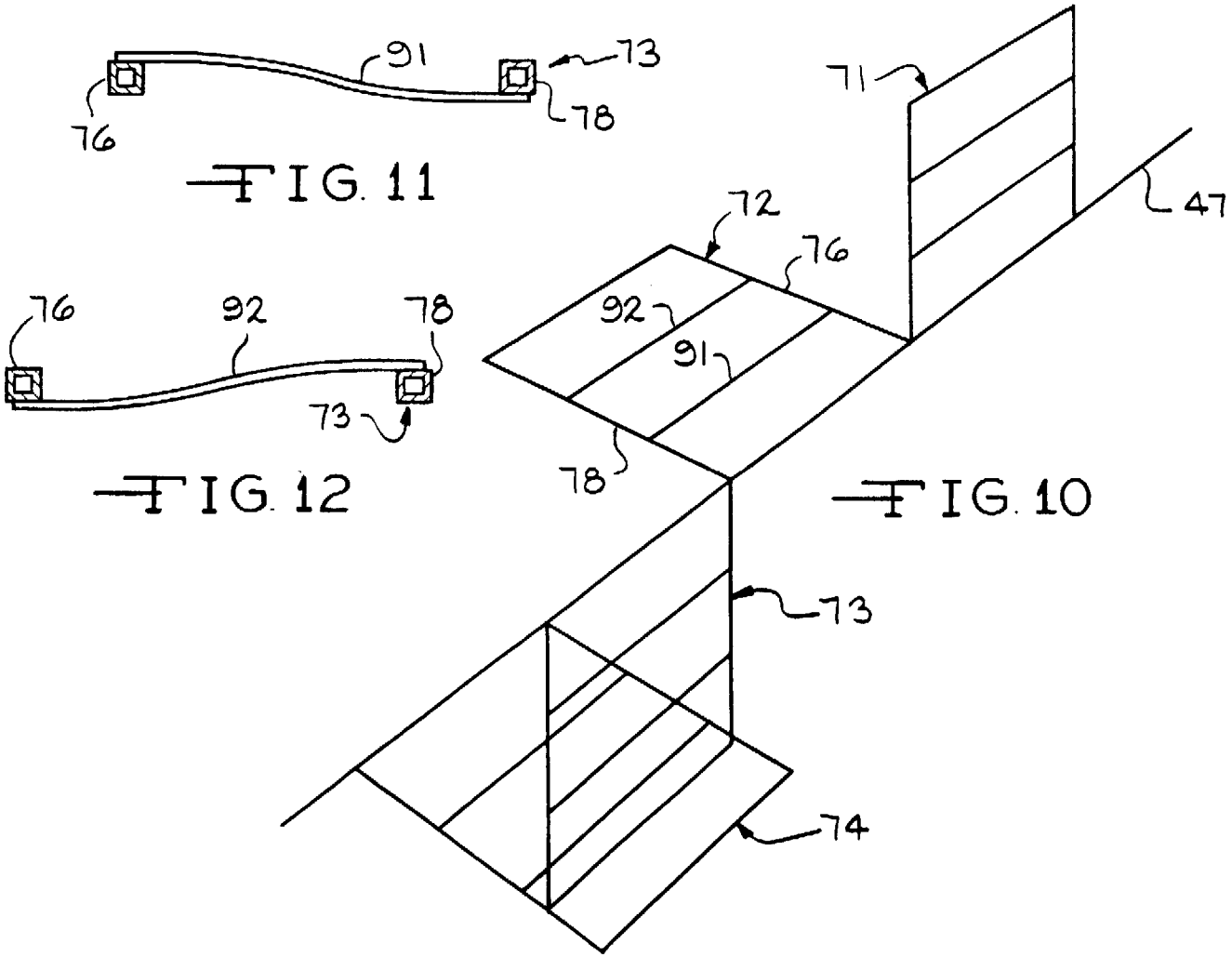
FIG. 10 presents a three dimensional, schematic view of the stirrer paddles removed from the material supply tank.
FIG. 11 presents a cross sectional view as taken along line 11—11 in FIG. 1.
FIG. 12 presents a cross sectional view taken along line 12—12 in FIG. 1.

A stirring mechanism 46, within storage tank 12, is illustrated in FIGS. 1, 6, 6A, and 10. Stirring mechanism 46 generally comprises four tandemly arranged, grid like, metal, generally planer, open frame like paddles 71, 72, 73, and 74, affixed to a square, axially disposed drive shaft 47 at ninety degree increments as best illustrated in FIG. 10. Shaft 47 is supported at either end of tank 12 by suitable bearing assemblies 35 and 37. See FIG. 5. A portion of drive shaft 47 protrudes through the rear bearing assembly within rear wall 17 of storage tank 12 and is provided with drive wheel, or pulley, 25. Hydraulic motor 44 is slightly offset from pulley 25, as shown in FIG. 4, and powers drive shaft 47 by way of a sprocket chain drive 39. Motor is preferably variable speed and reversible so that stirring mechanism 46 may be rotated clockwise or counter clockwise and at rotational speeds suitable for the material being applied.

Each of the four, open framework, paddles includes two serpentine, agitator, cross pieces 91 and 92 extending crosswise between radially extending frame members 76 and 78 as illustrated in FIGS. 11 and 12. It is to be noted that cross pieces 91 and 92 form an elongated figure "S" shape between frame members 76 and 78 and that the elongated "S" shape of cross piece 92 is the reverse of cross piece 91. It is the presence of these reversed elongated figure "S" cross pieces, between frame members 76 and 78, on each paddle 71, 72, 73, and 74, that produce a twisting, rolling and twirling action thereby affording quicker and more precise mixing of the material components within tank 12.

As the stirring mechanism 46 rotates within storage tank 12, flexible rubber wiping blades 45, attached to mechanism 46, wipingly engage the inside surface of tank 12 thereby preventing a build-up of sealing material upon the tank's inner surface.

Front wheel assemblies 126 and 127 are typical of those wheel and bearing assemblies as found on automobile front wheel assemblies. Thus the dual front wheels may be as easily steered as the prior art tricycle wheel and wheel assemblies 126 and 127 may be as easily removed, for servicing, as any ordinary automobile wheel assembly.

In accordance with the provisions of the patent statutes, the principle and mode of operation of my invention has been illustrated and described in what is considered to represent its preferred embodiment. However, it should be understood that the invention can be practiced otherwise than as specifically illustrated and described without departing from its spirit or scope.

I claim:

1. A ride-on, self propelled, pavement maintenance vehicle for applying abrasive liquid material upon a roadway surface comprising:

a) an elongate storage tank for storing said abrasive liquid material, said tank having its longitudinal axis generally parallel to the centerline of said vehicle, b) a forwardly extending support structure affixed to the forward end of said storage tank, c) a pair of laterally opposed, power driven, support wheel means affixed to the rear of said storage tank, d) steerable dual wheel means, including a rotatable vertical shaft, having affixed thereto, a horizontally disposed axle bar, said axle bar having, at each end thereof, a wheel mounting means, for rotatable attaching vehicle support wheels thereupon, affixed to said forwardly extending support structure for steering said vehicle when in motion, e) engine means affixed to said forwardly extending support structure for providing driving power to said power driven support wheels, f) hydraulic means for conveying motive power from said engine means to said power driven support wheels, g) means for applying said abrasive liquid material upon the roadway surface being treated, h) air driven dual diaphragm pump for withdrawing said abrasive liquid material from said storage tank and delivering said abrasive liquid material, under pressure, to said means for applying said abrasive liquid material to said surface, i) air compressor means, driven by said engine, for providing air, under pressure, to said air driven dual diaphragm pump means, j) platform means, affixed to the rear of said storage tank, for accommodating the operator of said vehicle thereupon.

2. The maintenance vehicle as claimed in claim 1 including rotatable grid-like, metal, generally planar, open frame, mixing paddles, each affixed to a common axial and rotatable shaft, each paddle extending radially outward from said shaft, each paddle axially tandem to the other, agitator means extending between each of the mixing paddles, said agitator means, a generally flat strap-like, serpentine cross piece, within said storage tank, for continuously mixing the liquid material therein; said mixing paddle means powered by a hydraulic motor external to said storage tank.

* * * * *